US010376759B2

(12) United States Patent
Toya

(10) Patent No.: US 10,376,759 B2
(45) Date of Patent: Aug. 13, 2019

(54) GOLF CLUB

(71) Applicant: GLOBERIDE, Inc., Tokyo (JP)

(72) Inventor: Tadashi Toya, Tokyo (JP)

(73) Assignee: GLOBERIDE, INC., Tokyo (JP)

( * ) Notice: Subject to any disclaimer, the term of this patent is extended or adjusted under 35 U.S.C. 154(b) by 0 days.

(21) Appl. No.: 15/882,072

(22) Filed: Jan. 29, 2018

(65) Prior Publication Data

US 2018/0214751 A1 Aug. 2, 2018

(30) Foreign Application Priority Data

Jan. 31, 2017 (JP) ..... 2017-015554

(51) Int. Cl.

| | |
|---|---|
| ***A63B 53/10*** | (2015.01) |
| *A63B 60/08* | (2015.01) |
| *A63B 53/00* | (2015.01) |
| *A63B 53/02* | (2015.01) |

(52) U.S. Cl.

CPC ..... *A63B 53/10* (2013.01); *A63B 53/02* (2013.01); *A63B 60/08* (2015.10); *A63B 2053/002* (2013.01); *A63B 2209/02* (2013.01); *A63B 2209/023* (2013.01); *A63B 2209/026* (2013.01)

(58) Field of Classification Search

CPC ..... A63B 53/10; A63B 2209/02; A63B 2209/023; A63B 2209/026

USPC ..... 473/319–321, 316, 318, 314

See application file for complete search history.

(56) References Cited

U.S. PATENT DOCUMENTS

| | | | | |
|---|---|---|---|---|
| 5,437,450 | A * | 8/1995 | Akatsuka | A63B 53/10 473/320 |
| 6,056,648 | A | 5/2000 | Kusumoto et al. | |
| 6,106,413 | A * | 8/2000 | Kusumoto | A63B 53/10 473/319 |
| 8,057,617 | B2 * | 11/2011 | Fujimoto | A63B 53/10 156/188 |
| 8,845,452 | B2 * | 9/2014 | Sato | A63B 53/10 473/319 |
| 2009/0264216 | A1 * | 10/2009 | Kato | A63B 53/10 473/319 |
| 2012/0309558 | A1 | 12/2012 | Nakano | |
| 2013/0143688 | A1 | 6/2013 | Sato | |

FOREIGN PATENT DOCUMENTS

JP 2012-245309 A 12/2012

OTHER PUBLICATIONS

First Office Action dated Apr. 30, 2019 issued in corresponding Chinese Patent Application No. 201711457373.1 with English translation.

* cited by examiner

*Primary Examiner* — Benjamin Layno

(74) *Attorney, Agent, or Firm* — Pillsbury Winthrop Shaw Pittman, LLP

(57) ABSTRACT

One object is to provide a golf club equipped with a shaft made of FRP, the golf club being excellent in swing feeling and ball-hitting feeling and capable of stabilizing directional accuracy in ball hitting. The golf club according to the present invention is characterized in that it includes a shaft made of a fiber-reinforced resin mounted to a head, and the shaft is formed so that a variation of a ratio between torsional rigidity and bending rigidity (GIp/EI) is 0.2 or less over an entire length thereof.

4 Claims, 6 Drawing Sheets

| | Example A | | | Example B | | | Example C | | | Example D | | |
|---|---|---|---|---|---|---|---|---|---|---|---|---|
| Position | ΣEI | ΣGIp | GIp/EI | ΣEI | ΣGIp | GIp/EI | ΣEI | ΣGIp | GIp/EI | ΣEI | ΣGIp | GIp/EI |
| 0 | 3035892 | 1212312 | 0.399 | 2942580 | 1264687 | 0.430 | 2604904 | 2236512 | 0.859 | 2104325 | 1541043 | 0.732 |
| 50 | 2771463 | 1176682 | 0.425 | 2781703 | 1207560 | 0.434 | 2515990 | 2173827 | 0.864 | 2093899 | 1454366 | 0.695 |
| 100 | 2514833 | 1137800 | 0.452 | 2635260 | 1145729 | 0.435 | 2442161 | 2113280 | 0.865 | 2079554 | 1372602 | 0.660 |
| 150 | 2261711 | 1094261 | 0.484 | 2499872 | 1077565 | 0.431 | 2638962 | 2294463 | 0.869 | 2059400 | 1293781 | 0.628 |
| 200 | 2024464 | 1054856 | 0.521 | 2392514 | 1011014 | 0.423 | 2917271 | 2551420 | 0.875 | 2031663 | 1216042 | 0.599 |
| 250 | 1800973 | 1021709 | 0.567 | 2317300 | 946885.3 | 0.409 | 3213213 | 2825567 | 0.879 | 2031628 | 1162968 | 0.572 |
| 300 | 2024282 | 1125376 | 0.556 | 2238556 | 867825.5 | 0.388 | 3581142 | 3177452 | 0.887 | 2199375 | 1236017 | 0.562 |
| 350 | 2264604 | 1233191 | 0.545 | 2416082 | 905043.4 | 0.375 | 3975650 | 3555769 | 0.894 | 2500973 | 1403088 | 0.561 |
| 400 | 2521986 | 1344805 | 0.533 | 2724317 | 1000514 | 0.367 | 4396785 | 3960487 | 0.901 | 2826241 | 1582087 | 0.560 |
| 450 | 2796405 | 1459871 | 0.522 | 3054974 | 1100292 | 0.360 | 4844488 | 4391472 | 0.906 | 3175288 | 1772946 | 0.558 |
| 500 | 3087768 | 1578042 | 0.511 | 3408055 | 1204183 | 0.353 | 5318587 | 4848486 | 0.912 | 3548119 | 1975554 | 0.557 |
| 550 | 3395911 | 1698969 | 0.500 | 3783465 | 1311983 | 0.347 | 5818802 | 5331189 | 0.916 | 3944637 | 2189753 | 0.555 |
| 600 | 3720601 | 1822306 | 0.490 | 4181010 | 1423476 | 0.340 | 6344742 | 5839136 | 0.920 | 4364644 | 2415339 | 0.553 |
| 650 | 4061533 | 1947705 | 0.480 | 4600403 | 1538440 | 0.334 | 6895903 | 6371781 | 0.924 | 4807835 | 2652062 | 0.552 |
| 700 | 4344989 | 2037655 | 0.469 | 4955648 | 1626684 | 0.328 | 7471675 | 6928473 | 0.927 | 5230953 | 2873269 | 0.549 |
| 750 | 4637047 | 2127483 | 0.459 | 5323094 | 1716152 | 0.322 | 8004919 | 7437247 | 0.929 | 5626645 | 3075120 | 0.547 |
| 800 | 4937256 | 2216985 | 0.449 | 5702191 | 1806671 | 0.317 | 8508620 | 7912707 | 0.930 | 6034885 | 3282473 | 0.544 |
| 850 | 5245122 | 2305955 | 0.440 | 6122302 | 1918133 | 0.313 | 9057848 | 8426027 | 0.930 | 6455009 | 3494974 | 0.541 |
| 900 | 5508988 | 2376825 | 0.431 | 6506198 | 2027032 | 0.312 | 9620436 | 8963996 | 0.932 | 6886291 | 3712244 | 0.539 |
| 950 | 5569522 | 2377095 | 0.427 | 6470721 | 1994623 | 0.308 | 9903388 | 9396645 | 0.949 | 6963520 | 3785880 | 0.544 |
| 1000 | 5627361 | 2376003 | 0.422 | 6552722 | 2009416 | 0.307 | 10151790 | 9682952 | 0.954 | 7073949 | 3871710 | 0.547 |
| 1030 | 5660711 | 2374686 | 0.420 | 6600335 | 2017763 | 0.306 | 10268490 | 9820341 | 0.956 | 7138471 | 3922373 | 0.549 |
| 1050 | 5682359 | 2373530 | 0.418 | 6631390 | 2023101 | 0.305 | 10345187 | 9910982 | 0.958 | 7180730 | 3955777 | 0.551 |
| 1100 | 5734367 | 2369658 | 0.413 | 6706530 | 2035637 | 0.304 | 10532873 | 10134023 | 0.962 | 7283617 | 4037900 | 0.554 |
| | | MAX | 0.567 | | MAX | 0.435 | | MAX | 0.963 | | MAX | 0.732 |
| | | MIN | 0.399 | | MIN | 0.303 | | MIN | 0.859 | | MIN | 0.539 |
| | | MAX-MIN | 0.168 | | MAX-MIN | 0.132 | | MAX-MIN | 0.104 | | MAX-MIN | 0.194 |

Fig. 3

| | Comparative Example X | | | Comparative Example Y | | | Comparative Example Z | | |
|---|---|---|---|---|---|---|---|---|---|
| Position | ∑EI | ∑GIp | GIp/EI | ∑EI | ∑GIp | GIp/EI | ∑EI | ∑GIp | GIp/EI |
| 0 | 3968025 | 772414.5 | 0.195 | 1389000 | 1837761 | 1.323 | 2895151 | 887357.7 | 0.306 |
| 50 | 3627825 | 821894.5 | 0.227 | 1473286 | 1711896 | 1.162 | 2544694 | 882959.1 | 0.347 |
| 100 | 3281008 | 877418 | 0.267 | 1569403 | 1584453 | 1.010 | 2192655 | 876652.5 | 0.400 |
| 150 | 2921797 | 938622.3 | 0.321 | 1676819 | 1452903 | 0.866 | 1813538 | 841808.7 | 0.464 |
| 200 | 2544779 | 1005147 | 0.395 | 1794996 | 1314871 | 0.733 | 1692737 | 783466.7 | 0.463 |
| 250 | 2184271 | 1100995 | 0.504 | 1959166 | 1193983 | 0.609 | 1768680 | 731210.1 | 0.413 |
| 300 | 2200000 | 1237038 | 0.562 | 2200000 | 1237038 | 0.562 | 1884236 | 717863.3 | 0.381 |
| 350 | 2501747 | 1404392 | 0.561 | 2501747 | 1404392 | 0.561 | 2061074 | 774778 | 0.376 |
| 400 | 2827178 | 1583709 | 0.560 | 2827178 | 1583710 | 0.560 | 2246948 | 833388.9 | 0.371 |
| 450 | 3176402 | 1774926 | 0.559 | 3176402 | 1774926 | 0.559 | 2441713 | 893582.5 | 0.366 |
| 500 | 3549424 | 1977929 | 0.557 | 3549424 | 1977929 | 0.557 | 2645190 | 955242.1 | 0.361 |
| 550 | 3946148 | 2192562 | 0.556 | 3946148 | 2192563 | 0.556 | 2857164 | 1018247 | 0.356 |
| 600 | 4366373 | 2418623 | 0.554 | 4366373 | 2418623 | 0.554 | 3077388 | 1082474 | 0.352 |
| 650 | 4809798 | 2655861 | 0.552 | 4809798 | 2655861 | 0.552 | 3305580 | 1147795 | 0.347 |
| 700 | 5233151 | 2877586 | 0.550 | 5233151 | 2877586 | 0.550 | 3541423 | 1214079 | 0.343 |
| 750 | 5629077 | 3079947 | 0.547 | 5629077 | 3079947 | 0.547 | 3784567 | 1281191 | 0.339 |
| 800 | 6037560 | 3287836 | 0.545 | 6037560 | 3287836 | 0.545 | 4815160 | 1400623 | 0.291 |
| 850 | 6457934 | 3500898 | 0.542 | 6457934 | 3500898 | 0.542 | 5282478 | 1482835 | 0.281 |
| 900 | 6889476 | 3718753 | 0.540 | 6889476 | 3718753 | 0.540 | 5445705 | 1497443 | 0.275 |
| 950 | 6968577 | 3792986 | 0.544 | 6968577 | 3792986 | 0.544 | 5715476 | 1553069 | 0.272 |
| 1000 | 7081627 | 3879431 | 0.548 | 7081627 | 3879431 | 0.548 | 5988308 | 1608397 | 0.269 |
| 1030 | 7147726 | 3930463 | 0.550 | 7147726 | 3930463 | 0.550 | 6153246 | 1641401 | 0.267 |
| 1050 | 7191037 | 3964112 | 0.551 | 7191037 | 3964112 | 0.551 | 6263643 | 1663307 | 0.266 |
| 1100 | 7296555 | 4046848 | 0.555 | 7296555 | 4046848 | 0.555 | 6403216 | 1679255 | 0.262 |
| | | MAX | 0.563 | | MAX | 1.323 | | MAX | 0.492 |
| | | MIN | 0.195 | | MIN | 0.539 | | MIN | 0.262 |
| | | MAX-MIN | 0.368 | | MAX-MIN | 0.784 | | MAX-MIN | 0.230 |

Fig. 4

GOLF CLUB

CROSS-REFERENCE TO RELATED APPLICATIONS

This application is based on and claims the benefit of priority from Japanese Patent Application Serial No. 2017-15554 (filed on Jan. 31, 2017), the contents of which are hereby incorporated by reference in their entirety.

TECHNICAL FIELD

The present invention relates to a golf club and relates particularly to a golf club provided with a shaft made of a fiber-reinforced resin (FRP).

BACKGROUND

Shafts of golf clubs conventionally include those made of steel and those made of a fiber-reinforced resin (hereinafter, referred to as FRP). In general, a golf club equipped with a steel shaft provides an advantage that directional accuracy is stabilized, and a golf club equipped with an FRP shaft provides an advantage that a weight reduction can be achieved, thus increasing a swing speed and improving a launch angle and a carry.

Such an FRP shaft is formed by winding a plurality of prepreg sheets on a mandrel, the plurality of prepreg sheets including reinforcing fibers impregnated with a synthetic resin, and thermally curing them, followed by de-coring. While there are a wide variety of ways of configuring the prepreg sheets wound on the mandrel, for example, as disclosed in Japanese Patent Application Publication No. 2012-245309 (the '309 Publication), in a portion to which a head is mounted, a prepreg sheet for reinforcement (a prepreg sheet including reinforcing fibers oriented in an axial direction) is wound over a given distance (about 300 mm from a distal end thereof). The purpose of this is as follows. The shaft is formed so as to be decreased in diameter near a distal end thereof, and therefore, in the portion to which the head is mounted, an outer surface of the shaft and an inner surface of a fitting hole of a hosel portion of the head are fixed to each other so as to form a straight shape, and this fixing region and a vicinity thereof are prevented from being decreased in strength.

Conceivably, the reason why a golf club equipped with a steel shaft exhibits excellent directional accuracy in ball hitting as described above is that metal has an isotropic property, so that a ratio between torsional rigidity and bending rigidity (GIp/EI) of the steel shaft is uniform over a length direction thereof. In contrast, as for an FRP shaft, while it provides an advantage that, compared with a steel shaft, a weight reduction can be achieved, thus increasing a swing speed and improving a launch angle and a carry, FRP has longitudinal and transverse elastic moduli varying depending on an orientation of reinforcing fibers and thus has an anisotropic property, so that a ratio between torsional rigidity and bending rigidity (GIp/EI) of the FRP shaft varies over a length direction thereof. Conceivably, this is the reason for not being able to stabilize directional accuracy as much as a steel shaft does.

In the FRP shaft disclosed in the '309 Publication, as described above, the prepreg sheet for reinforcement (hereinafter, referred to as a reinforcement sheet) including reinforcing fibers oriented in the axial direction is arranged in a distal end region to which the head is mounted, ending up causing a problem in stabilizing directional accuracy. That is, in a case where such a reinforcement sheet is arranged, bending rigidity is increased in the distal end region, and since the number of winding turns increases toward the distal end, as shown in FIG. 1A where a horizontal axis (mm) represents a longitudinal direction of the shaft and a vertical axis (Kgf·mm$^2$) represents bending rigidity, there is obtained a bending rigidity distribution in which the bending rigidity has an inflection point in a neighborhood of 300 mm from the distal end and increases toward the distal end. In this case, the reason why the bending rigidity is lowest in the neighborhood of 300 mm from the distal end is that when the reinforcement sheet has a length of about 300 mm, this part forms an end portion of the reinforcement sheet (the number of winding turns is 0). In a case where the above-described reinforcement sheet is not arranged, the bending rigidity directly decreases toward the distal end with no inflection point occurring in the neighborhood of 300 mm.

The reinforcement sheet thus wound includes reinforcing fibers oriented in the axial direction and thus significantly affects bending rigidity, while directionality thereof hardly affects torsional rigidity. Because of this, similarly to FIG. 1A, there is obtained a torsional rigidity distribution as shown in FIG. 1B where a horizontal axis (mm) represents the longitudinal direction of the shaft and a vertical axis (Kgf·mm$^2$) represents torsional rigidity.

Accordingly, in the FRP shaft with the reinforcement sheet wound thereon, the reinforcement sheet including reinforcing fibers oriented in the axial direction, a variation of the ratio between torsional rigidity and bending rigidity (GIp/EI) is increased in the distal end region (the ratio between torsional rigidity and bending rigidity varies over the length direction thereof), leading to a problem in stabilizing directional accuracy. Particularly in playing golf by use of a golf club set composed of a golf club equipped with a steel shaft and a golf club equipped with an FRP shaft, there occurs a difference in feeling of bowing and feeling of torsion between these both types of golf clubs, making a miss-shot likely to occur. Further, while achieving a weight reduction and thus providing ease of swinging, the golf club equipped with an FRP shaft makes it difficult to stabilize directional accuracy.

SUMMARY

In view of the above-described problems, an object of the present invention is to provide a golf club equipped with a shaft made of FRP, the golf club being excellent in swing feeling and ball-hitting feeling and capable of stabilizing directional accuracy in ball hitting.

In order to achieve the above-described object, a golf club according to the present invention is characterized in that it includes a shaft made of a fiber-reinforced resin and mounted to a head, and the shaft is formed so that a variation of a ratio between torsional rigidity and bending rigidity (GIp/EI) is 0.2 or less over an entire length thereof.

Typically, a swing feeling and a ball-hitting feeling given by a golf club to a golf player are largely affected by torsional rigidity and bending rigidity of a shaft of the golf club. That is, since torsional rigidity is resistance to torsion and bending rigidity indicates how unlikely deformation is with respect to bending, the higher torsional rigidity is, the more likely it is that the shaft transmits a feeling in hand to a head of the golf club (the higher reactivity of the shaft is), and a decrease in bending rigidity makes it possible for the shaft to use deformation of itself to hit a ball. In this case, as for the ratio between torsional rigidity and bending rigidity, when the ratio is uniform (forming a flat straight-line graph) over an entire length of the shaft, the shaft has isotropy, thus providing a uniform rigidity feeling as a whole and also stabilizing directional accuracy in ball hitting. That is, when the ratio largely changes (has large variations) depending on a position on the shaft in an axial direction, it is likely that a sense of discomfort occurs in terms of a swing feeling and a ball-hitting feeling, which is not preferable in stabilizing ball hitting. Particularly in a case where a golf club having such large variations is included in one set of golf clubs, a feeling gap (a difference in feel) between the golf clubs becomes large. For example, in a case where a golf club with a steel shaft and a golf club with an FRP shaft having a large value of the ratio are both used in one round of golf, there occurs a large feeling gap between the golf clubs, possibly resulting in a miss-shot.

The shaft having the above-described configuration is formed so that a variation of the ratio between torsional rigidity and bending rigidity (GIp/EI) is 0.2 or less over the entire length thereof so that the variation of the ratio is extremely decreased. Therefore, the shaft has a property approximate to isotropy of a steel shaft, making it possible to improve a swing feeling and a ball-hitting feeling and to stabilize directional accuracy in ball hitting. Furthermore, since the shaft is made of FRP, there is obtained a golf club being lightweight and providing ease of swinging.

Advantages

According to the present invention, there is obtained a golf club equipped with a shaft made of FRP, the golf club being excellent in swing feeling and ball-hitting feeling and capable of stabilizing directional accuracy in ball hitting.

BRIEF DESCRIPTION OF THE DRAWINGS

FIG. 3 is a chart illustrating characteristics of each of examples of a shaft according to the present invention.

FIG. 4 is a chart illustrating characteristics of each of comparative examples as opposed to the shaft according to the present invention.

DESCRIPTION OF THE EMBODIMENTS

Figure 2:
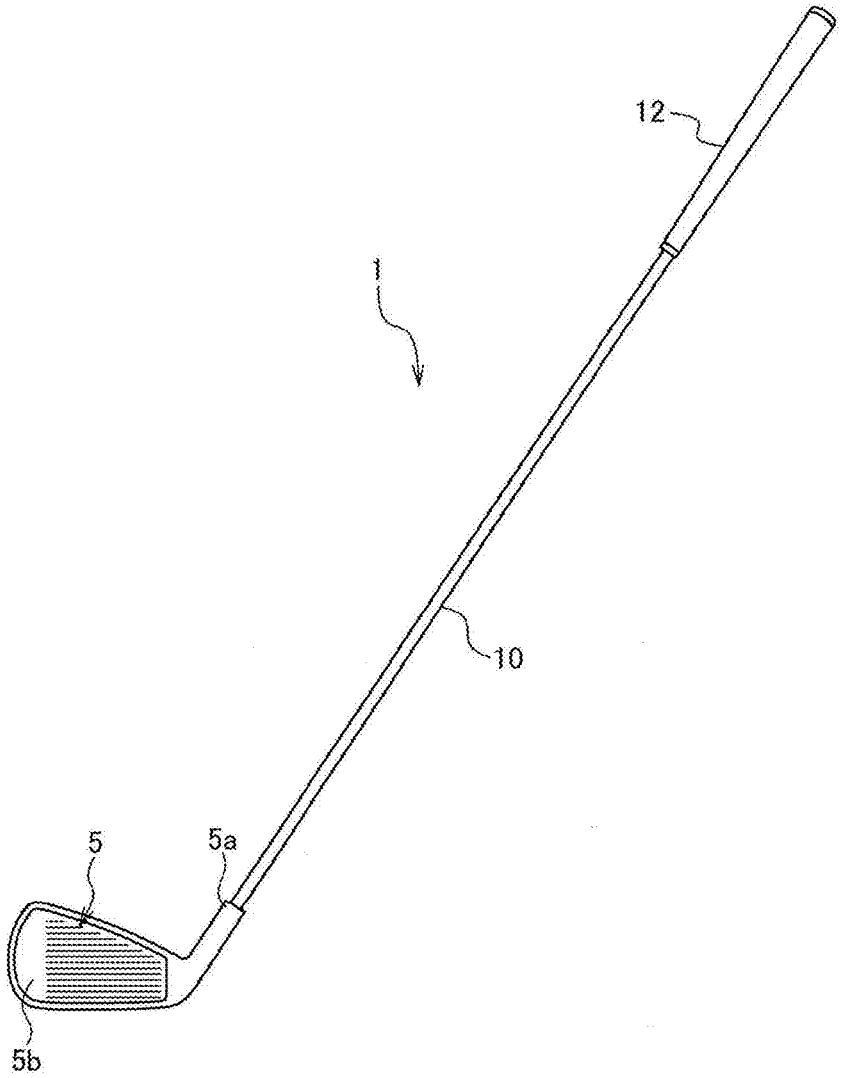
FIG. 2 is a front view showing one example of a golf club according to the present invention.

An embodiment of a golf club according to the present invention is hereinafter described with reference to the appended drawings. FIG. 2 is a view showing one example of the golf club according to the present invention.

A golf club 1 shown in FIG. 2 illustratively represents an iron-type golf club and has a head (an iron head) 5 mounted to a distal end of a shaft 10 and a grip 12 made of rubber or the like and mounted to a proximal end of the shaft 10. The head 5 has a hosel 5*a* for inserting the shaft 10 thereinto and fixing a distal end region thereof and a plate-like face portion 5*b* used to hit a ball, and a range in which an outer surface of the shaft 10 and an inner surface of a fitting hole of the hosel 5*a* are fixed to each other is set to approximately 25 mm to 40 mm, though it depends on a type of a golf club.

As is known, the shaft 10 is made of FRP and formed by winding a plurality of prepreg sheets on a mandrel, the plurality of prepreg sheets being formed by impregnating reinforcing fibers with a synthetic resin, and thermally curing them, followed by de-coring. In this case, a prepreg sheet for reinforcement (a reinforcement sheet) is wound on the distal end region of the shaft 10 for reasons such as that the distal end region is decreased in diameter by being tapered, that the head 5 as a heavy additional item is mounted thereto, and that the distal end region is subjected to an impact when hitting a ball. The reinforcement sheet can improve bending rigidity and torsional rigidity of the distal end region and carries out a function of forming a straight-shaped fixing region between the inner surface of the fitting hole of the hosel 5*a* and the outer surface of the shaft 10, thus improving fixing strength of the head 5. An example of a configuration and an arrangement of the prepreg sheets and the reinforcement sheet wound on the mandrel will be mentioned later.

In the present invention, an FRP shaft mounted to a head is configured to have characteristics described below. Here, prior to describing a configuration of a shaft according to this embodiment, a description is specifically given of characteristics of a shaft forming a basic principle of the present invention.

Rigidity of a shaft largely affects a feeling given to a golfer when he/she swings, and the golfer can intuitively grasp bending rigidity and torsional rigidity upon swinging and hitting a ball (grasp a rigidity feeling given by the shaft).

The higher bending rigidity of the shaft is, the less likely it is that the shaft bows (the larger so-called tension of the shaft is), and thus a shaft having high rigidity has characteristics suited for a golfer having a high swing speed. On the other hand, a shaft having low rigidity allows its bowing to be used to hit a ball and thus has characteristics suited for a golfer having a low swing speed. Such bowing can be intuitively perceived by a golfer upon swinging, and even by simply holding a grip and swinging the shaft in an up-down direction, rigidity of the shaft can be visually grasped.

Furthermore, torsional rigidity of the shaft affects an operational feeling in a rotational direction, and a golfer can intuitively grasp the torsional rigidity as resistance or reactivity in a torsional direction at a grip portion. That is, a shaft having high torsional rigidity gives such a sensation that a feeling of torsion at a grip is directly transmitted to a head, while a shaft having low torsional rigidity gives such a sensation that a feeling of torsion at a grip is transmitted to a head with a slight margin (degree of freedom).

Since a golfer can intuitively grasp the above-described bending rigidity and torsional rigidity during a time between swinging and hitting a ball, it can be said that, preferably, in a shaft, characteristics of bending rigidity and torsional rigidity agree with each other over an entire length thereof. To be more specific, a shaft having the bending rigidity distribution shown in FIG. 1A has a bending rigidity characteristic in which bending rigidity has an inflection point at a position substantially 300 mm from a distal end thereof and increases toward the distal end, while having a torsional rigidity characteristic in which torsional rigidity decreases toward the distal end with no such inflection point occurring.

Accordingly, in a golf club equipped with a shaft having such characteristics, when the shaft is considered over an entire length thereof, a gap has occurred between a bending rigidity feeling and a torsional rigidity feeling, and thus a golfer intuitively senses a difference in feeling of bowing and feeling of torsion (is given a sense of discomfort). That is, conceivably, in a case where a bending rigidity distribution curve and a torsional rigidity distribution curve substantially agree in shape with each other, no gap occurs between a bending rigidity feeling and a torsional rigidity feeling, and thus a golf club providing excellent feelings can be obtained.

Figure 1A:
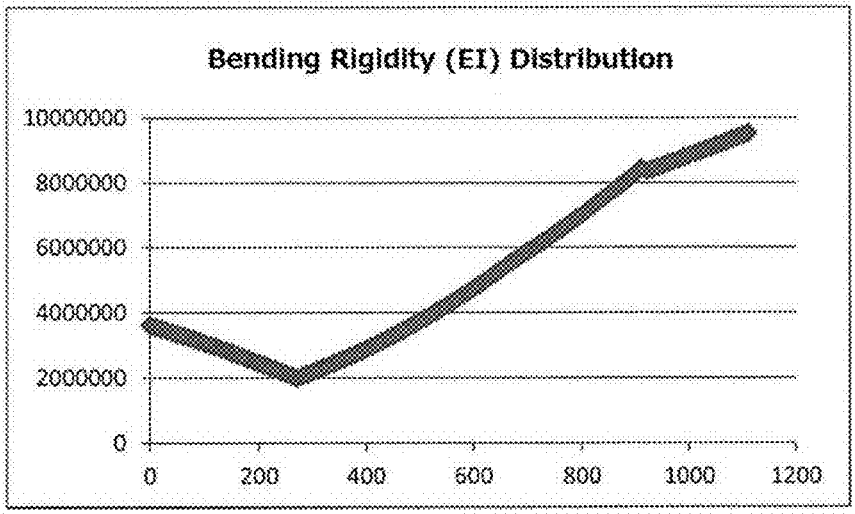
Fig. 1A (Related Art)
FIG. 1A is a graph illustrating a bending rigidity distribution of a conventional FRP shaft.
Figure 1B:
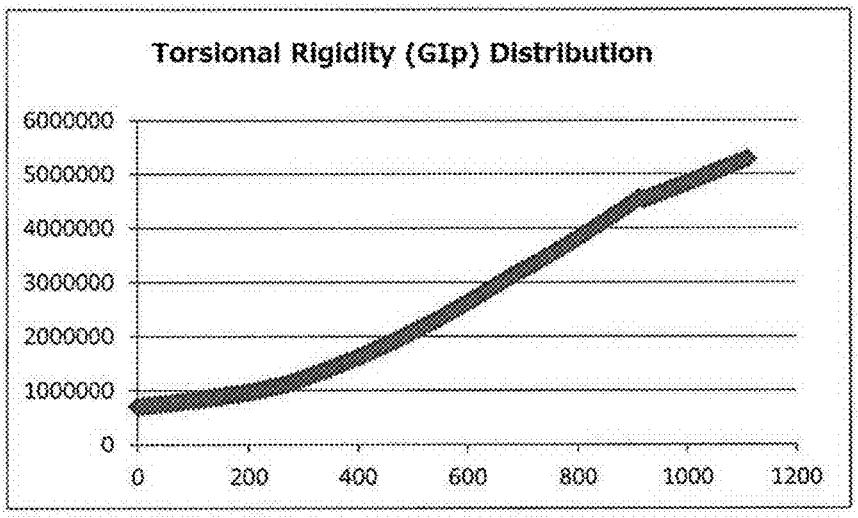
Fig. 1B (Related Art)
FIG. 1B is a graph illustrating a torsional rigidity distribution of the conventional FRP shaft.

Specifically, in a shaft having rigidity distribution curves as shown in FIGS. 1A and 1B, torsional rigidity is set to have an inflection point at a position substantially 300 mm from a distal end thereof and increase toward the distal end, and thus the torsional rigidity distribution curve shown in FIG. 1B can be made approximate to the curve shown in FIG. 1A. In this case, in order to improve torsional rigidity, most effective is to wind a reinforcement sheet including reinforcing fibers oriented at ±45° with respect to an axial direction of the shaft, and the reinforcement sheet (including reinforcing fibers oriented at ±45° with respect to the axial direction) could be wound so that the number of winding turns increases toward a distal end of the shaft. Conversely, by eliminating the reinforcement sheet including reinforcing fibers oriented in the axial direction, the bending rigidity distribution curve shown in FIG. 1A can be made approximate to the torsional rigidity distribution curve shown in FIG. 1B. Such a configuration, however, no longer has an effect of reinforcing a head and thus is not preferable from the viewpoint of strength.

A steel shaft is made of metal and thus has isotropy, so that over an entire length of the shaft, respective distributions of bending rigidity and torsional rigidity become substantially the same, and a ratio between the bending rigidity and the torsional rigidity becomes substantially uniform (forms a substantially straight-line graph over the entire length of the shaft, with a variation of substantially zero). Thus, there can be obtained a golf club, though being increased in weight as a golf club, providing excellent feelings because no gap has occurred between a bending rigidity feeling and a torsional rigidity feeling.

As described above, an FRP shaft is affected by an orientation of reinforcing fibers in prepreg sheets wound thereon and thus is characterized by having anisotropy. Therefore, although in distribution characteristics as shown in FIGS. 1A and 1B, a ratio between bending rigidity and torsional rigidity (GIp/EI) is not made uniform over an entire length of the shaft, by making contrivance to an arrangement of the prepreg sheets, particularly, to a configuration of a reinforcement sheet arranged in a distal end region near a head, the ratio between bending rigidity and torsional rigidity can be made uniform (a variation can be decreased).

The present invention is characterized in that, over an entire length of an FRP shaft, a ratio between bending rigidity and torsional rigidity (GIp/EI) is made uniform (a variation (a fluctuation width) thereof is minimized as much as possible), and the ratio is set not to be displaced (the variation is set to 0) over the entire length or the variation is made approximate to 0 so that feelings provided by the shaft are made approximate to those provided by a steel shaft.

Figure 5:
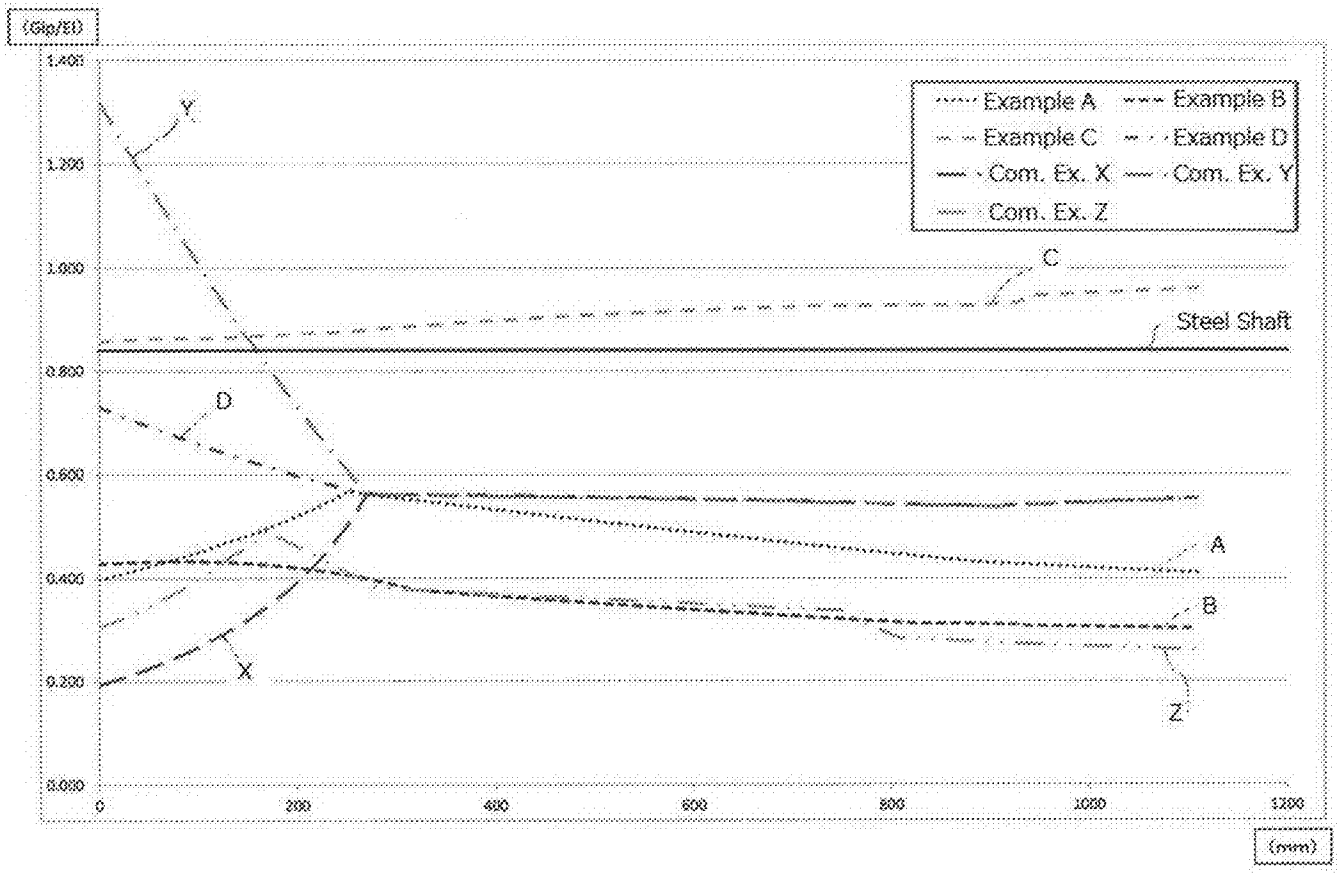
FIG. 5 is a graph illustrating characteristics of the examples and the comparative examples shown FIGS. 3 and 4, respectively.

Next, with reference to FIG. 3 to FIG. 5, a description is specifically given of values of a variation of the ratio between bending rigidity and torsional rigidity (GIp/EI) when made uniform over an entire length of a shaft, the values being such that excellent feelings can be obtained. Herein, a plurality of golf club shafts having the same type of heads mounted thereto are prepared. There are shown characteristics of shafts as opposed to a configuration of the present invention as Comparative Example X, Comparative Example Y, and Comparative Example Z (see FIG. 4), and there are shown characteristics of shafts according to the present invention as Example A, Example B, Example C, and Example D (see FIG. 3).

In FIG. 3 and FIG. 4, where a distal end of each of the shafts is defined to be 0 and positions on the each of the shafts are set at intervals of 50 mm, numerical values shown are values of bending rigidity (ΣEI) and torsional rigidity (ΣGIp) determined at the respective positions and values of the ratio (GIp/EI) therebetween derived from their respective values (the bending rigidity (ΣEI) and the torsional rigidity (ΣGIp) are expressed in a unit Kgf·mm$^2$). Furthermore, for each of the shafts, a maximum value (MAX) and a minimum value (MIN) of (GIp/EI) are shown along with a difference therebetween (MAX−MIN). Accordingly, the larger this difference is, the larger the variation is. In tables shown in FIG. 3 and FIG. 4, values of the bending rigidity (τEI) and the torsional rigidity (ΣGIp) at the positions on each of the shafts at intervals of 50 mm and values of the ratio (GIp/EI) are expressed to three decimal places. Some of these examples and comparative examples, however, have maximum values and minimum values of the ratio (GIp/EI) occurring at positions not specified in the tables. That is, a minimum value (0.303) of the ratio of Example B is determined at a position of 1110 mm, and a maximum value (0.963) of the ratio of Example C is determined at the position of 1110 mm. Furthermore, a maximum value (0.563) of the ratio of Comparative Example X is determined at a position of 280 mm, a minimum value (0.539) of the ratio of Comparative Example Y is determined at a position of 910 mm, and a maximum value (0.492) of the ratio of Comparative Example Z is determined at a position of 170 mm.

In this case, bending rigidity (EI) and torsional rigidity (GIp) are derived by a calculation method below. Regarding the bending rigidity (EI), a Young's modulus (a longitudinal elastic modulus) E can be determined by a calculation based on a configuration (a material) of prepreg sheets as a component of a shaft and an arrangement mode (a laminated structure) thereof, and I (a cross-sectional secondary moment) can be derived by $I=\pi(D24-D14)/64$ (Expression 1). Furthermore, regarding the torsional rigidity (GIp), a shear elastic modulus (a transverse elastic modulus) G can be determined, similarly to the above, by a calculation based on a configuration (a material) of prepreg sheets as a component of a shaft and an arrangement mode (a laminated structure) thereof, and Ip (a cross-sectional torsional moment) can be derived by $Ip=\pi(D24-D14)/32$ (Expression 2). In (Expression 1) and (Expression 2) above, D2 indicates an outer diameter of a shaft and D1 indicates an inner diameter of the shaft. Furthermore, since an FRP shaft is formed by winding a plurality of sheets of materials thereon, numerical values regarding the shaft as a whole are determined by adding up values determined for respective layers thereof.

Bending rigidity (EI) of an actually molded FRP shaft can be derived by a technique in which the shaft is laid horizontally and supported at two points a distance (L/2) away from a measurement point thereon, and a deflection amount (6) of the shaft when a force (P) is applied from above to a position of the middle measurement point is measured. Specifically, the bending rigidity (EI) can be derived from a calculation expression $EI=(L3/48)\times(P/\delta)$. A maximum load P is 20 Kgf, and a distance L between portions thus supported is 200 mm. By the above-described technique, EI at the middle position measurement point between the two-point supported portions can be determined, and by shifting positions of the supported portions, it becomes possible to continuously determine numerical values of EI.

Furthermore, torsional rigidity (GIp) of the actually molded FRP shaft can be derived by a technique in which the shaft is laid horizontally with one end portion thereof secured, and retained at a position L mm away from that secured portion, and a torsional angle A (radian) when a torque Tr is applied to that retained portion is measured. Specifically, the torsional rigidity (GIp) can be derived from a calculation expression GIp=L×Tr/A. The toque Tr is 139 (Kgf·mm), and a distance L between the secured portion and the retained portion on the shaft is 200 mm. By the above-described technique, GIp at a middle position between the secured portion and the retained portion of the shaft can be determined, and by shifting the positions, it becomes possible to continuously determine numerical values of GIp.

As mentioned above, a steel shaft has isotropy, and thus the ratio GIp/EI is made uniform over an entire length of the shaft, a value of which, however, slightly varies depending on a Poisson's ratio (ν) of a constituent material of the shaft. When iron is considered to be a principal component of the shaft, a Poisson's ratio of the shaft is about 0.3, and thus it is conceived that the ratio GIp/EI has a value of about 0.87 based on a relationship E=2(1+ν). For this reason, in an actual steel shaft, it is conceived that the ratio GIp/EI has a value falling within a range of 0.85±0.1, though it depends on a constituent material of the steel shaft (0.85 in FIG. 5 referred to below).

FIG. 5 is a graph plotting a value of the ratio (GIp/EI) of each of the shafts shown in FIG. 3 and FIG. 4 with respect to a longitudinal direction (a horizontal axis) of the each of the shafts. In each of Examples A, B, C, and D, an arrangement and a configuration of prepregs wound (after-mentioned body prepreg sheets and reinforcement prepreg sheet) are set so that a variation of the ratio is 0.2 or less. Example C is set to have a lowest variation and a value of the ratio approximate to 1 (a displacement within a range of 0.8 to 1.0), thus being configured to have characteristics most approximate to those of a steel shaft.

On the other hand, Comparative Example X is set so that a variation of the ratio is 0.368, Comparative Example Y is a shaft whose variation of the ratio is set to 0.784, and Comparative Example Z is set so that a variation of the ratio is made approximate to 0.2, having a value of 0.230. As described above, when a variation of the ratio is increased, feelings are deteriorated, and the more approximate the variation is to 0, the more improved the feeling are. Herein, as a result of prior study in the form of a simulation, it was predictable to some extent that when a variation of the ratio is within 0.2 or less, an improvement in feelings can be expected. Based on this, in an actual sensory test, shafts set to have a variation in a neighborhood of 0.2 were prepared (Example D has a value of 0.194 and Comparative Example Z has a value of 0.2030), and an actual examination thereof was performed.

The following describes how the sensory test was performed and a result thereof. In the sensory test, the seven golf clubs shown in FIG. 3 and FIG. 4 were prepared, and ten typical average golfers were asked to conduct trial ball hitting by use of the golf clubs. In this case, the seven golf clubs were randomly provided to the golfers, and the golfers were asked to hit at least ten or more balls and make a relative assessment of the golf clubs. In the relative assessment, the golfers were asked to mark a golf club he/she assessed as excellent in feeling at a time of ball hitting and in directional accuracy with a circle (○)(one or more or a plurality of golf clubs may be selected), a golf club he/she assessed, relative to the golf club he/she assessed as excellent, as slightly poorer but within a tolerable range with a triangle (Δ) (one or more or a plurality of golf clubs may be selected), and a golf club he/she assessed, relative to the golf club he/she assessed as excellent, as being so poor that it should be improved with a cross (x)(one or more or a plurality of golf clubs may be selected). A result thereof is shown in a table below.

TABLE 1

| | Example A (0.168) | Example B (0.132) | Example C (0.104) | Example D (0.194) | Comparative Example X (0.368) | Comparative Example Y (0.784) | Comparative Example Z (0.230) |
|---|---|---|---|---|---|---|---|
| A | ○ | Δ | ○ | Δ | X | X | Δ |
| B | Δ | ○ | ○ | ○ | Δ | X | Δ |
| C | ○ | Δ | Δ | Δ | X | X | X |
| D | ○ | ○ | ○ | Δ | X | X | X |
| E | Δ | ○ | ○ | Δ | X | Δ | ○ |
| F | Δ | ○ | ○ | Δ | Δ | X | Δ |
| G | Δ | Δ | ○ | ○ | X | X | Δ |
| H | ○ | ○ | ○ | Δ | Δ | X | Δ |
| I | X | ○ | Δ | X | X | X | Δ |
| J | Δ | Δ | ○ | ○ | Δ | X | ○ |

As shown in the assessment result above, Example C having a variation of 0.104, Example B having a variation of 0.132, and Example A having a variation of 0.168 were assessed as excellent or within a tolerable range and thus can be assessed as being golf clubs providing excellent feelings.

In contrast, Comparative Example X having a variation of 0.368 and Comparative Example Y having a variation of 0.784 were assessed by many of the golfers as being so poor that the shafts should be improved. Furthermore, as for Example D having a variation of 0.194 and Example Z having a variation of 0.230, although results of the assessment thereof slightly varies, as a result of considering results of the assessment of Examples A, B, and C and results of the assessment of Comparative Examples X and Y, in the present invention, it was determined that a variation of 0.2 is practically a limit value up to which excellent feelings can be obtained (for example, when ○, Δ, and x are converted into scores of 2 points, 1 point, and 0 points, respectively, Example D has 12 points and Comparative Example Z has 10 points, and thus in the present invention, a limit value of a variation was determined to be 0.2).

As in the present invention, when made of FRP, a golf club shaft can achieve a weight reduction and thus provides ease of swinging. Further, the shaft is formed so that a variation of the ratio between torsional rigidity and bending rigidity (GIp/EI) is 0.2 or less over an entire length thereof and thus provides a feeling of torsion and a feeling of bowing approximate to each other, so that it becomes possible to achieve a stable shot and to stabilize directional accuracy. Furthermore, in a case where a golf club equipped with such a shaft is included in a golf club set together with a golf club equipped with a steel shaft, even when these both types of golf clubs are used in a round of golf, there occurs no significant sense of discomfort, and it becomes possible to achieve a stable shot between uses of the both types of golf clubs.

Figure 6:
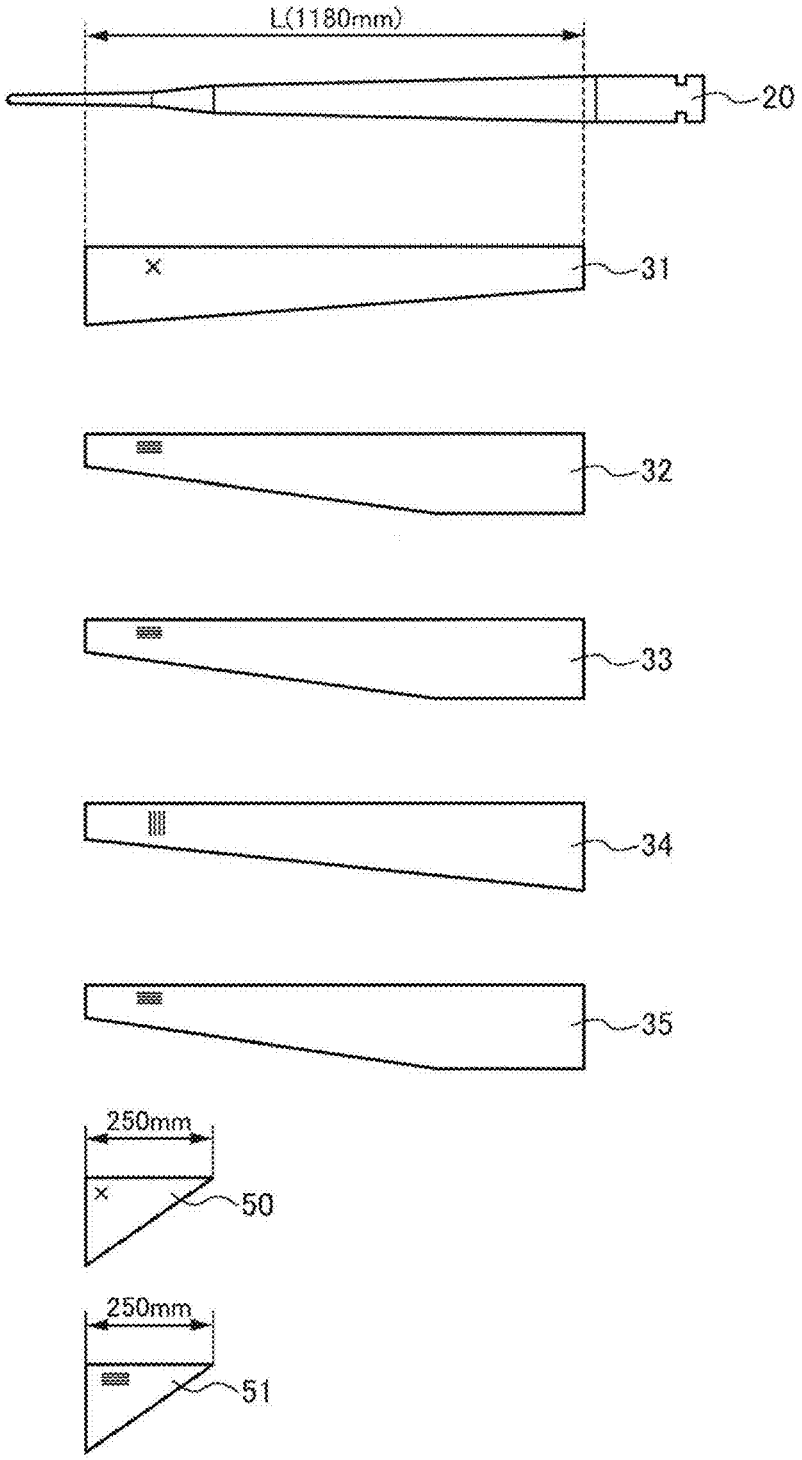
FIG. 6 is a pattern diagram showing an example of an arrangement and a configuration of a prepreg sheet and a prepreg sheet for reinforcement used to form the shaft of the golf club according to the present invention.

Next, with reference to FIG. 6, a description is given of a configuration example of a shaft having the characteristics described above. FIG. 6 is a pattern diagram showing one example of an arrangement and a configuration of a prepreg sheet and a prepreg sheet for reinforcement, the arrangement and the configuration being such that the above-described characteristics of a shaft can be obtained.

In this configuration example, it is intended to make a torsional rigidity distribution as shown in FIG. 1B agree in shape with a bending rigidity distribution as shown in FIG. 1A, and the prepreg sheet for reinforcement (a reinforcement sheet) wound on a distal end region of a shaft has a distinguished configuration. Specifically, the shaft of this embodiment is formed by sequentially winding body prepreg sheets (body sheets) on a mandrel 20 decreased in diameter near a distal end thereof, finally winding the reinforcement sheet, heating and firing a thus obtained wound body in that state, followed by de-coring, and subjecting it to surface treatment or the like. In this case, the mandrel 20 has a region whose length L (1180 mm) constitutes an entire length of the shaft.

As the body sheets, a plurality of body sheets are wound to constitute the entire length (form a body layer) of the shaft, and among the plurality of body sheets, a body sheet 31 constituting an inner most layer is formed by overlaying a first diagonally oriented sheet and a second diagonally oriented sheet on each other, the first diagonally oriented sheet including reinforcing fibers oriented in a +45° direction with respect to an axial direction, the second diagonally oriented sheet including reinforcing fibers oriented in a −45° direction with respect to the axial direction, and cutting a thus obtained overlaid body so that, for example, it is wound 3.6 plies at the distal end and 1.2 plies at a proximal end. Each of body sheets 32 and 33 wound over the body sheet 31 includes reinforcing fibers arranged regularly in the axial direction and cut, for example, so as to be wound one ply at the distal end to form an over ply and wound one ply at the proximal end to form an over ply. A body sheet 34 wound over the body sheets 32 and 33 includes reinforcing fibers arranged regularly in a circumferential direction and cut, for example, so as to be wound one ply at the distal end to form an over ply and wound one ply at the proximal end to form an over ply. A body sheet 35 wound over the body sheet 34 includes reinforcing fibers arranged regularly in the axial direction and cut, for example, so as to be wound one ply at the distal end to form an over ply and wound one ply at the proximal end to form an over ply.

Among the above-described plurality of body sheets wound, ones which include reinforcing fibers arranged regularly in the axial direction contribute to an improvement in bending rigidity, and one of them which includes reinforcing fibers oriented in crossed directions contributes to an improvement in torsional rigidity. In this case, although a body sheet including reinforcing fibers oriented at ±45° most effectively contributes to an improvement in torsional rigidity, there is no limitation on an angle of orientation. Furthermore, one of them which includes reinforcing fibers arranged regularly in the circumferential direction contributes to an improvement in strength against crush.

The reinforcement sheet is wound on the distal end region (the distal end to which a head is mounted) of the shaft. The reinforcement sheet is wound in an area extending up to 250 mm from the distal end and has a first reinforcement sheet 50 and a second reinforcement sheet 51 including reinforcing fibers oriented in the axial direction. The first reinforcement sheet 50 is formed by overlaying a first diagonally oriented sheet and a second diagonally oriented sheet on each other, the first diagonally oriented sheet including reinforcing fibers oriented in a +45° direction with respect to the axial direction, the second diagonally oriented sheet including reinforcing fibers oriented in a −45° direction with respect to the axial direction.

In this case, although the first reinforcement sheet 50 and the second reinforcement sheet 51 may be wound discontinuously in a circumferential direction (part of the body sheets may be interposed therebetween), it is preferable that, as shown in FIG. 6, the first reinforcement sheet 50 and the second reinforcement sheet 51 be wound continuously, and it is more preferable that these reinforcement sheets be arranged in an outermost layer so as to be continuous with each other. By continuously winding the first reinforcement sheet 50 and the second reinforcement sheet 51 in this manner, they can be wound without an interstice being generated therebetween in a radial direction. Moreover, by winding the first reinforcement sheet 50 and the second reinforcement sheet 51 in an outer layer (the outermost layer), it becomes easier to set the ratio between bending rigidity and torsional rigidity (GIp/EI) to 0.2 or less.

It is preferable that the first and second diagonally oriented sheets constituting the first reinforcement sheet 50 have a thickness of 0.1 mm or less (0.2 mm or less in a state of being laminated to each other), and it is preferable that the first and second reinforcement sheets 50 and 51 be configured so that a thickness of each of the first and second diagonally oriented sheets <a thickness of the second reinforcement sheet 51<a thickness of the first reinforcement sheet (in a state where the first and second diagonally oriented sheets are laminated to each other) 50. This is because an increase in thickness makes it likely that the first reinforcement sheet 50 wound on an inner side and the second reinforcement sheet 51 wound on an outer side are positionally shifted from each other, ending up forming a large step between a winding start position and a winding end position, so that it becomes difficult for them to carry out a function as an outer diameter adjuster.

The first reinforcement sheet 50 is configured by laminating a sheet cut in one direction, for example, at a fiber angle of +45° so as to be wound 2 plies at a distal end position and 0 plies at a proximal end position (a position 250 mm from the distal end) to a sheet cut at a fiber angle of −45° so as to have the same dimensions as those of the above-described sheet. Furthermore, the second reinforcement sheet 51 is cut so as to be wound 5.21 plies at the distal end position and 0 plies at the proximal end position (a position 250 mm from the distal end). As described above, the first reinforcement sheet 50 and the second reinforcement sheet 51 are wound so that their respective end portions on a grip side are aligned with each other, and thus their respective positions of an inflection point agree with each other, so that it is possible to prevent the ratio between bending rigidity and torsional rigidity (GIp/EI) from being largely displaced.

In the above-described configuration, it is only required that the ratio between bending rigidity and torsional rigidity (GIp/EI) be set to 0.2 or less, and a configuration of the first and second reinforcement sheets 50 and 51 can be modified as appropriate. Depending on a size of the first and second reinforcement sheets 50 and 51, however, a variation of the ratio can no longer fall within 0.2 or less, so that attention should be given to a type or a size of a material thereof. For example, while, in a configuration shown in FIG. 6, a cross sheet (the first reinforcement sheet 50) is arranged on an inner side, this sheet may be arranged on an outer side. Furthermore, both these sheets may be wound discontinuously in a circumferential direction or their respective end positions on the grip side may be slightly shifted in the axial direction. Furthermore, although there is no particular limitation on a length of the first and second reinforcement sheets 50 and 51 in the axial direction, an excessive increase in length thereof results in a weight increase, and thus it is preferable that the length be set to about 300 mm or less. Moreover, although there is no particular limitation on an orientation of cross-oriented reinforcing fibers in the first reinforcement sheet 50, when the reinforcing fibers are oriented at ±45°, it is possible to efficiently improve torsional rigidity and thus to reduce the number of winding turns.

The foregoing has described the embodiment of the present invention. The present invention, however, is not limited to the above-described embodiment, and various modifications can be made thereto. In the present invention, it is only required that the shaft be formed so that a variation of the ratio between torsional rigidity and bending rigidity (GIp/EI) is 0.2 or less over an entire length thereof, and configurations of the first and second reinforcement sheets 50 and 51 and the body sheets 31 to 35 can be modified as appropriate as long as such a condition is satisfied. For example, the above-described numbers of plies of the sheets are presented merely as one example, and in the pattern diagram shown in FIG. 6, a body sheet(s) may be further wound or a prepreg sheet for adjustment may be further wound. Furthermore, it may also be possible that a reinforcement sheet is wound also on a grip region constituting the proximal end.

Furthermore, a numerical value of the ratio between torsional rigidity and bending rigidity (GIp/EI) can also be modified as appropriate. While, in the graph shown in FIG. 5, the steel shaft having isotropy has a value of the ratio in a neighborhood of 0.85 over an entire length thereof, in the present invention, a configuration may be adopted in which the ratio has a value of larger than 1.0 and a variation is 0.2 or less (for example, within a range of 1.1 to 1.3).

What is claimed is:

1. A golf club comprising:

a head; and a shaft made of a fiber-reinforced resin and mounted to the head, wherein the shaft is formed so that a variation of a ratio between torsional rigidity and bending rigidity (GIp/EI) is 0.2 or less over an entire length of the shaft;

wherein a prepreg sheet for reinforcement is wound on a distal end portion of the shaft, the head being mounted to the distal end portion, and wherein the prepreg sheet for reinforcement has a first reinforcement sheet and a second reinforcement sheet, the first reinforcement sheet and the second reinforcement sheet being arranged in an outermost layer of the shaft, the first reinforcement sheet including reinforcing fibers oriented in crossed directions, and the second reinforcement sheet including reinforcing fibers oriented in an axial direction.

2. The golf club according to claim 1, wherein the first reinforcement sheet includes reinforcing fibers oriented at ±45° with respect to the axial direction.

3. The golf club according to claim 1, wherein the first reinforcement sheet and the second reinforcement sheet are wound continuously and arranged in an outermost layer of the shaft.

4. The golf club according to claim 2, wherein the first reinforcement sheet and the second reinforcement sheet are wound so that respective ends thereof on a grip side are aligned with each other.

* * * * *